US007080491B1

(12) United States Patent
Shreiner et al.

(10) Patent No.: US 7,080,491 B1
(45) Date of Patent: Jul. 25, 2006

(54) EXPANSION JOINT COVER WITH MODULAR CENTER

(75) Inventors: Thomas A. Shreiner, Picture Rocks, PA (US); Howard J. Williams, Muncy, PA (US)

(73) Assignee: E.M.E.H. Inc., Lebanon, NJ (US)

( * ) Notice: Subject to any disclaimer, the term of this patent is extended or adjusted under 35 U.S.C. 154(b) by 1042 days.

(21) Appl. No.: 09/593,785

(22) Filed: Jun. 14, 2000

Related U.S. Application Data

(60) Provisional application No. 60/139,421, filed on Jun. 16, 1999.

(51) Int. Cl.
*E04B 1/62* (2006.01)
*E04F 15/14* (2006.01)
*E04F 15/22* (2006.01)

(52) U.S. Cl. ..... 52/393; 52/394; 52/395; 52/336; 404/69; 404/64

(58) Field of Classification Search ..... 52/336, 52/393, 395, 90.1, 394, 402, 450, 396.04, 52/573.1, 463; 404/69, 64, 68, 47
See application file for complete search history.

(56) References Cited

U.S. PATENT DOCUMENTS

| | | | | |
|---|---|---|---|---|
| 3,394,639 A | | 7/1968 | Viehmann | |
| 3,447,430 A | | 6/1969 | Gausepohl | |
| 3,745,726 A | | 7/1973 | Thom | |
| 3,967,426 A | * | 7/1976 | Ault et al. | 52/252 |
| 4,133,158 A | * | 1/1979 | Ting | 52/478 |
| 4,271,650 A | | 6/1981 | Lynn-Jones | |
| 4,295,315 A | | 10/1981 | Lynn-Jones et al. | |
| 4,461,131 A | * | 7/1984 | Pressell | 52/395 |
| 4,682,456 A | * | 7/1987 | Hartman et al. | 52/220.4 |
| 4,706,432 A | * | 11/1987 | Fishburn | 52/407.1 |
| 4,837,994 A | * | 6/1989 | Stohs | 174/48 |
| 4,893,448 A | | 1/1990 | McCormick | |
| 5,078,529 A | | 1/1992 | Moulton | |
| 5,197,250 A | | 3/1993 | Kramer | 52/396 |
| 5,575,126 A | | 11/1996 | Attaway et al. | |
| 5,628,857 A | | 5/1997 | Baerveldt | |
| 5,911,662 A | * | 6/1999 | Hallsten | 52/246 |
| 6,098,359 A | * | 8/2000 | Stodulka | 52/252 |

* cited by examiner

*Primary Examiner*—Carl D. Friedman
*Assistant Examiner*—Chi Q. Nguyen
(74) *Attorney, Agent, or Firm*—Baker Botts L.L.P.

(57) ABSTRACT

A modular center plate for a cover that bridges the expansion gap and is supported by frame members of an expansion joint cover is made up of a plurality of formed members, each formed member being rectangular in plan and of uniform cross-section along an axis and having side edges parallel to the axis. The formed members are arranged with their side edges adjacent each other and with their ends overlying the support surfaces of the frame members of the expansion joint cover. End frame members are attached to the end edges of the formed members.

14 Claims, 6 Drawing Sheets

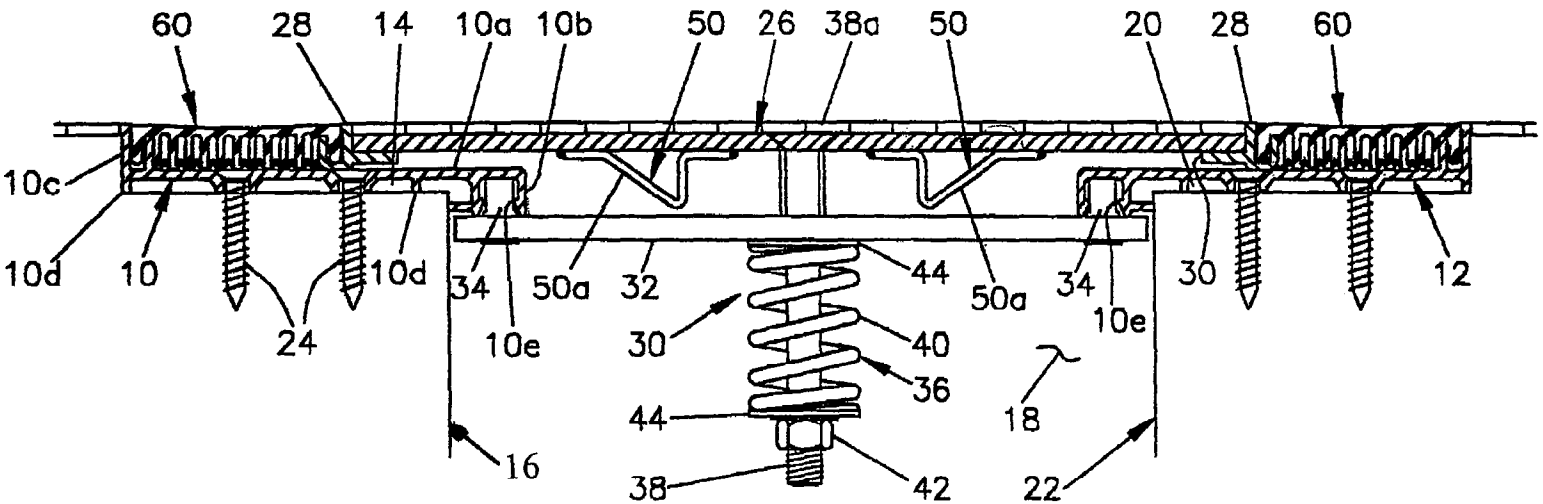
FIG. 1 – PRIOR ART
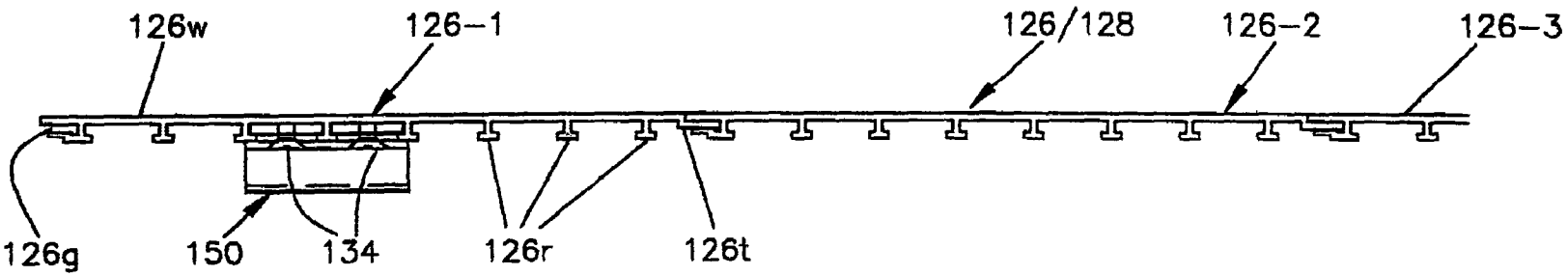
FIG. 3

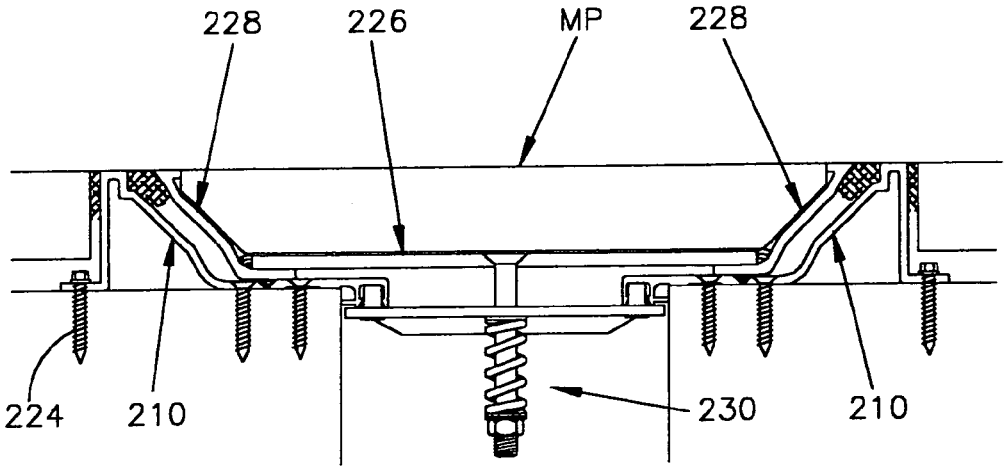
FIG. 5 – PRIOR ART
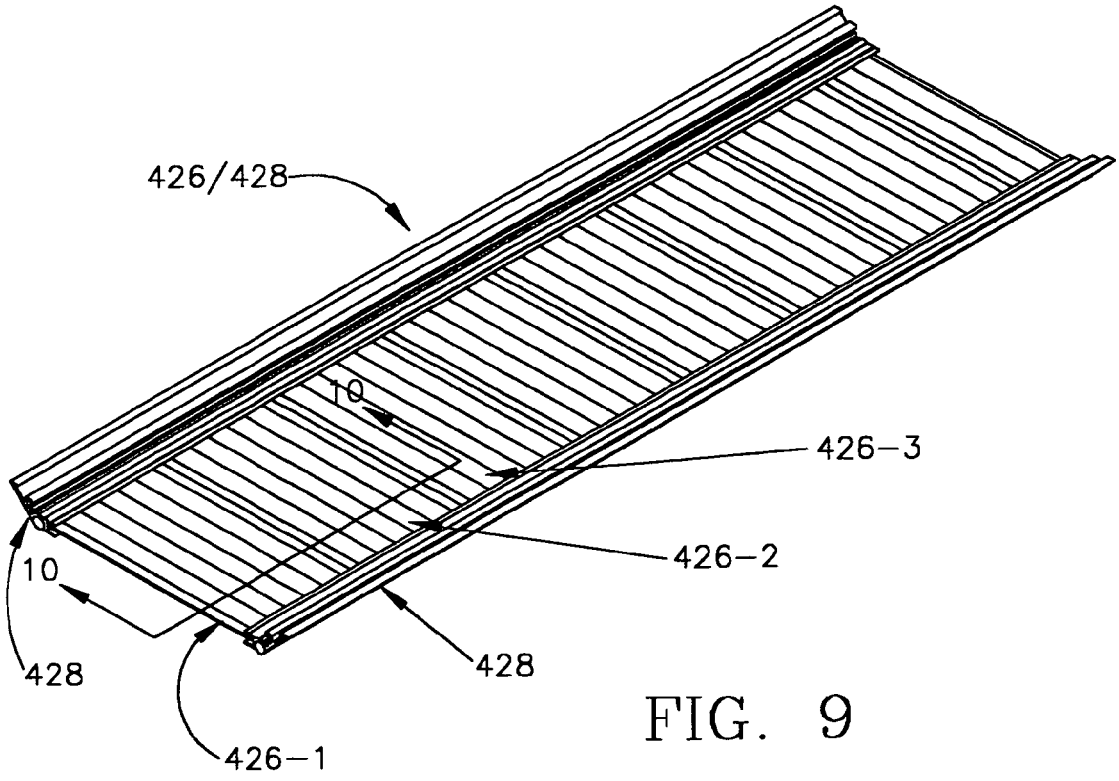
FIG. 9

EXPANSION JOINT COVER WITH MODULAR CENTER

REFERENCE TO PRIOR APPLICATION

The present application is based on U.S. Provisional Patent Application No. 60/139,421 filed Jun. 16, 1999.

BACKGROUND OF THE INVENTION

In relatively large buildings designed to withstand earthquakes, the expansion joints are virtually always designed to endure excursions of the building members at the joints of more than four inches and may be designed for excursions of up to 20 inches or more. Conventionally, the expansion gap is bridged by an elongated cover, one side of which is supported on a frame affixed to a building member on one side of the gap and the other side of which is supported on a frame affixed to a building member on the other side of the gap. Ordinarily, the cover of an expansion joint cover is fabricated from a flat center plate of aluminum plate stock and an adapter or nosing along each side. The ability of the center plate to support loads is, of course, a function of the thickness of the plate material. The wider the expansion gap at the maximum excursion of the building members away from each other in an earthquake, the thicker the cover plate must be for a given load-carrying ability. Aluminum plates of a thickness of, say, ¼ inch or more, are required for relatively wide expansion gaps.

Aluminum plate stock is relatively costly. Fabrication of the center plates from plate stock also involves a fair amount of waste. Usually, the adapters or nosings are welded to the center plate. The cost of a cover for a seismic expansion joint cover can be appreciable, due to the high cost of the plate stock, the waste, and the labor and capital costs for welding the adapters or nosings to the center plate.

SUMMARY OF THE INVENTION

One object of the present invention is to provide a center plate for an expansion joint cover that for any given strength requires significantly less material and that is made from stock that is considerably less costly than aluminum plate. Another object is to reduce the amount of waste resulting from production of center plates. It is also an object to simplify and reduce the costs of the assembly of a center plate to adapters or nosings to form a cover for an expansion joint cover. It is also desired to facilitate the fastening of accessory components to a center plate.

The foregoing and other objects are attained, in accordance with the present invention, by an improved cover for an expansion joint cover that has a pair of elongated frames, each of which is adapted to be secured to a building member, one on one side of an expansion gap and the other on the other side of the expansion gap, and each of which has a planar support surface that supports the cover for sliding movement of the frames relative to each other and the cover. The center plate of the cover extends across the expansion gap and is a component of the cover. In some cases, the center plate consists solely of side by side formed members, which are configured to be load-bearing and carry the loads of people and articles that cross over the expansion joint. In other cases, the cover includes the modular center plate and other components that are received on the modular center plate and carry the loads.

The modular center plate of the present invention is composed of a plurality of formed members, each of which is rectangular in plan and of uniform cross-section along an axis and has side edges parallel to the axis. The formed members are arranged with their side edges adjacent each other and with their ends overlying the support surfaces of the frame members.

As used herein, the term "formed member" means a member formed, such as by extrusion or roll-forming, so as to have segments extending parallel to the axis that are spaced apart above and below a neutral plane of bending, which inherently impart bending strength. Examples of such segments are corrugations and ribs. The formed members of the modular center plate may be made of metal, such as aluminum or steel, or of plastic.

The assembly of a center plate for the cover of an expansion joint cover from a number of formed members has several advantages over aluminum plate stock, including the following:

- Formed members as a stock material for fabrication of articles are usually significantly less expensive than plates having the same bending strength; for example, aluminum extrusions are from about 30% to 40% less expensive on a weight basis than aluminum plate stock;
- The cross-sectional shape of the formed members permits the area moment of inertia to be increased significantly, as compared to a plate—hence, for a given bending strength, the controlling property for expansion joint cover center plates, formed members may have a total cross-sectional area, and thus weight, that is about 30% less than the area of a plate;
- The amount of waste is limited to small pieces left after cutting formed stock into pieces of the required lengths—cutting plate stock often leaves relatively large pieces that are too small for use in making other center plates;
- The relatively small thickness of the formed members makes it economical to use mechanical fasteners rather than welding for connections to other members; and
- forming by extrusion or roll-forming makes it possible to form cross-sectional shapes, such as flutes or grooves, that enhance bonding of floor surface or subsurface materials to the center plate and permit mechanical attachment of accessories to the center plate.

In preferred embodiments, adjacent pairs of formed members are coupled together side by side, such as by slip joints or by nesting. To that end, each formed member may have a pair of flanges that form a groove along one side edge and a single flange or tongue along the other side edge that is received in the groove of an adjacent formed member. For reasons of economy all of the formed members of the modular center plate are of the same cross-section—i.e., they can all be cut to length from the same formed stock.

In most cases, a modular center plate embodying the present invention will have a continuous edge frame member affixed to each end of the plurality of formed members. The edge frame member unites the side-by-side formed members and will usually have one or more other functions, as described below. A suitable form of edge frame member may include spaced-apart upper and lower flanges forming a groove that receives end portions of the formed members. Mechanical fasteners, such as rivets or self-tapping screws, may be used at intervals to secure the formed members in the grooves.

A common form of center plate for an expansion joint cover provides a flat upper surface on which a finish floor covering, such as vinyl tile or carpet, is supported. For that purpose, one form of modular center plate is made from extruded members, each of which has a continuous planar upper web portion. The bending strength is provided by a plurality of spaced apart dependent ribs extending downwardly from the web portion. An advantageous form for the ribs is an inverted "T"-shape in cross-section, which adds material at the lower extremity farthest from the neutral axis of bending, thus increasing the bending strength. The "T" shaped ribs also can receive nut plates by which accessories, such as deflectors and mounts for centering turn bars, can be fastened to the underside of the center plate.

Where the center plate is formed to provide a pan or trough for floor finishes such as natural stone, poured pavers, bricks or the like, each of the formed members may be corrugated. In addition to increasing the bending strength, as compared with a plate, corrugations enhance the bonding of a cementitious bed for the floor material or for a concrete floor. Corrugations forming dovetail grooves facing upwardly are desirable for that purpose. In particular, each of the formed members may have a plurality of transversely spaced-apart planar upper web portions, a plurality of transversely spaced-apart planar lower web portions staggered between the upper web portions, and a rib portion joining each edge of each upper web portion to an edge of each lower web portion. That form of corrugations maximizes the amounts of material farthest above and below the neutral axis of bending for high bending strength. Ordinarily, the upper web portions of all of the formed members are coplanar, and the lower web portions of all of the formed members are likewise coplanar.

A very economical modular center plate consists of roll-formed steel sheet with corrugations and a planar steel surface sheet supported on and secured to the upper webs of the corrugated sheet. A finish floor material, such as carpet or vinyl tile, may be applied to the surface sheet.

DESCRIPTION OF THE DRAWINGS

For a more complete understanding of the present invention, and the advantages thereof, reference may be made to the following written description of exemplary embodiments, taken in conjunction with the accompanying drawings.

FIG. 1 is a cross-sectional view of a seismic expansion joint cover that is known in the prior art and is one of many types in which a modular center plate according to the present invention can be used;

FIG. 3 is a partial cross-sectional view of the modular center plate of FIG. 2, taken along the lines 3—3 of FIG. 2;

FIG. 5 is a cross-sectional view of another seismic expansion joint cover that is known in the prior art and is another type in which a cover with a modular center plate according to the present invention can be used;

FIG. 9 is a perspective view of another embodiment of a cover with a modular center plate that is suitable for use in the expansion joint cover shown in FIG. 5;

DESCRIPTION OF THE EMBODIMENTS

Figure 2:
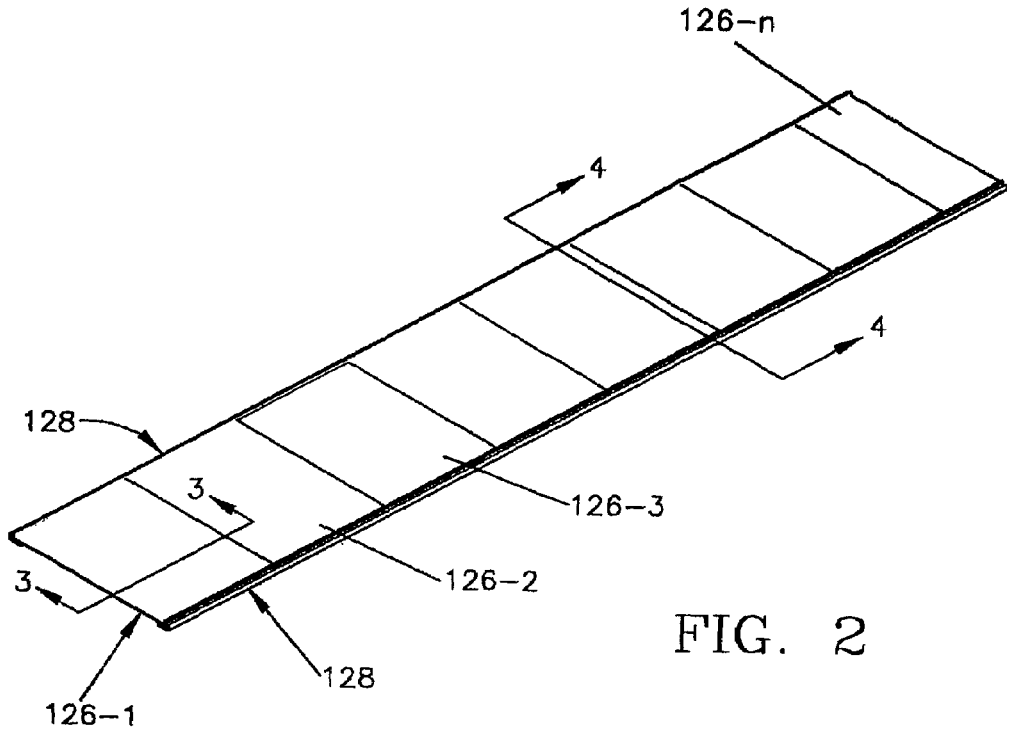
FIG. 2 is a perspective view of one embodiment of a cover having a modular center plate that is suitable for use in the expansion joint cover shown in FIG. 1.

U.S. Pat. No. 5,078,529 (Moulton, 1992, hereinafter "the '529 patent"), which is owned by the assignee of the present invention, describes and shows an expansion joint cover in which the exposed surface of a cover is normally—"normally" meaning at all times other than in an earthquake that produces large motions of the building members—held flush with the surfaces of the building members on opposite sides of the expansion gap by resilient hold-down assemblies. The hold-down assemblies include turning bars that maintain the cover centered in the gap. In an earthquake, the hold-down assemblies allow the cover to lift up so that the edges lie above the surfaces of the building members when they move toward each other, thereby preventing the cover from being caught between the building members and being destroyed. Gaskets installed in the gaps between adapters along the edges of the cover and the frames of the expansion joint cover are configured to release in an earthquake. The expansion joint cover of the '529 patent is designed to endure an earthquake without being damaged and to normally provide a load-carrying surface across the gap that is flush with the surfaces of the building members on opposite sides and the expansion gap. Flush seismic expansion joint covers based on the '529 patent are available commercially from Conspec Systems, Inc., Muncy, Pa., as Model SGR. The '529 patent is incorporated by reference into the present specification for all purposes.

A previously known seismic expansion joint cover, according to the '529 patent, is shown in FIG. 1. It includes a pair of frames 10 and 12, one of which is installed in a recess 14 in a building member 16 on one side of an expansion gap 18 and the other 12 of which is installed in a recess 20 in another building member 22 on the other side of the expansion gap 18. The frames 10 and 12 are essentially longitudinally continuous along the length of the gap 18 (subject to length restrictions in production and shipping) and are aluminum extrusions of uniform cross-section along their lengths. The same cross-section is used on both sides of the joint, one being reversed end to end with respect to the other. Each frame 10 has a planar support portion 10*a*, an edge portion 10*b* that overhangs the gap 18, and an edge flange portion 10*c* at the edge of the support portion remote from the gap. Ribs 10*d* on its underside provide a standoff of the support portion from the bottoms of the recesses in the building members to facilitate accommodation of the frames to surface irregularities. The frames are secured to the building members by masonry anchors 24.

An elongated center plate 26 extends lengthwise of the joint and spans it crosswise. An adapter 28 is fastened by welding to each edge of the center plate 26 and supports the center plate 26 in sliding relation on the support portion of the respective frame 10. Various adapters 28 having different dimensions can be provided to permit the upper surface of the center plate 26 to be located at different positions with respect to an adjacent floor and floor tile (as shown), carpet or other floor coverings to be applied to the cover member flush with the floor coverings within the space in the building where the expansion joint cover is located.

The cover—i.e., the center plate 26 and the adapters 28—of the expansion joint cover is normally retained in engagement with the support portions 10*a* of the frames 10 by a multiplicity of hold-down assemblies 30 that are spaced apart at suitable intervals along the length of the expansion joint. Each hold-down assembly includes a pivot or turning bar 32 that extends across the expansion gap obliquely to the longitudinal axis of the expansion gap, engages the frames against upward movement and has its opposite ends slidably coupled to the respective frames by means of stainless steel pivot pins 34, each of which is received in a channel portion 10*e* of the frame 10 that opens downwardly from the overhanging edge portion 10*b*. A spring mechanism 36 couples the cover to each pivot bar and urges the cover resiliently into engagement with the frames. Each spring mechanism includes a bolt 38 that passes through a hole in the cover and a hole in the pivot bar 32 and a compression spring 40 engaged under compression between the pivot bar and an abutment 42 on a portion of the bolt on the side of the pivot bar opposite from the cover. The portion of the bolt adjacent the pivot bar is threaded, and the abutment 42 consists of a nut 43 and a washer 44 interposed between the nut 43 and the spring 40, the washer and nut being welded to the spring. This arrangement enables the compression force of the spring 40 to be adjusted from within the building space by turning the bolt 38, such as by using an inch/pound torque wrench. Another washer 44 is interposed between the upper end of the spring and the pivot bar. The head portion 38*a* of each bolt 38 is countersunk into the hole in the cover. The margins of the holes in the cover for the bolts are reinforced by collars 46 welded to the underside of the cover around each hole.

A multiplicity of deflector members 50 are located on the underside of the cover 26. Each deflector member has an inclined surface 50*a* that is engageable by the edge 10*b* of one of the frames 10 upon narrowing of the expansion gap during a seismic event and is adapted upon such engagement to displace the cover against the bias of the hold-down assembly 30 to a position in which its side edges are not susceptible to contact with any portions of the frames or the building members upon further narrowing of the expansion gap. Each deflector member 50 is a metal band having a generally V-shaped body portion, one leg of which constitutes the inclined surface 50*a*, and arm portions joined to the body portion and to the cover member 10. The deflector members 50 are pieces cut to a desired length, 2 inches being suitable, from an elongated aluminum extrusion having a cross-section such as to define the body portions and the arm portions of the deflector members 50. The deflector members are arranged in opposite-facing pairs at a suitable longitudinal spacing along the cover.

An elongated expandable and compressible gasket 60 is releasably joined to each side edge of the cover 26 and to the edge flange portion 10*c* of the corresponding frame 10 such that each gasket detaches from the edge flange portion of the frame upon displacement of the cover in a seismic event. Each gasket 60 is coformed from thermoplastic rubber compounds of different hardnesses. The major part of the gasket, which consists of walls defining numerous oval-shaped cells, is of a softer compound that enables it to deform readily. Portions along each edge of an inverted, generally "U" shape are formed of a harder compound, which enables them to be attached relatively securely by reception of a dependant side leg of the harder compound in a groove. One side leg of each gasket 60 is received in a groove defined by legs of the adapter 28 of the cover, and the other side leg of each gasket is received in a groove defined by the edge flange portion of each frame 10.

Figure 4:
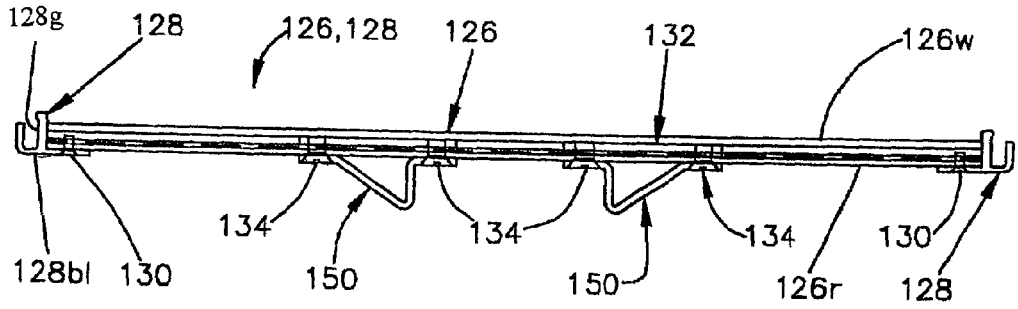
FIG. 4 is a cross-sectional view taken along the lines 4—4 of FIG. 2.

FIGS. 2 to 4 show a cover 126/128 that replaces the cover—center plate 26 and adapters 28—of FIG. 1. The center plate 126 of FIGS. 2 to 4 is modular, in that it consists of several separate formed members 126-1, 126-2, 126-3, . . . 126-*n*, each of which is rectangular in plan and of uniform cross section along its length. All of the formed members 126 are identical and are formed by extrusion, preferably of aluminum. Each has a planar web portion 126*w*, which provides a flat upper surface for a floor-covering material, and spaced-apart ribs 126*r* of inverted "T"-shape in cross-section (see FIG. 3). A groove 126*g* along one side edge and a flange or tongue 126*t* along the other side edge of each member 126 mate to form a slip joint between adjacent pairs of formed members 126 when the modular center plate is assembled.

The cover 126/128 of FIGS. 2 to 4 has end frame members 128 that are coextensive with and joined, such as by blind rivets 130, to the end edges of the side-by-side formed members 128. The cover is supported on the frames 10 (FIG. 1) by a base leg portion 128*bl* of each end frame member. A pair of flanges form a groove 128*g* that receives an end lug of the gasket 60.

The undercut grooves between the ribs 126*r* provide sites for nut plates 132 that receive machine screws 134 by which deflectors 150 are fastened to the underside of the cover 126/128.

A variant of the expansion joint cover described and shown in detail in the '529 patent that is commercially available as the Model SRR floor cover from Conspec Systems, Inc., has a cover with a relatively deep pan or trough that allows it to receive thick floor finishes, such as masonry pavers (MP, FIG. 5) or the like up to 1½ inches deep. As shown in FIG. 5, the cover of the Model SSR expansion joint cover consists of an aluminum center plate 226 and nosings 228 that are welded to the center plate and form the side walls of the trough or pan. The cover is supported on frame members 210, which are secured in floor recesses by masonry anchors 224. Hold-down and turning bar assemblies 230 that are essentially the same as those described above and shown in FIG. 1 allow the cover to be lifted by a camming action between the adjacent, sloping portions of the frames 210 and the nosings 228 when the expansion gap closes in an earthquake.

Figure 6:
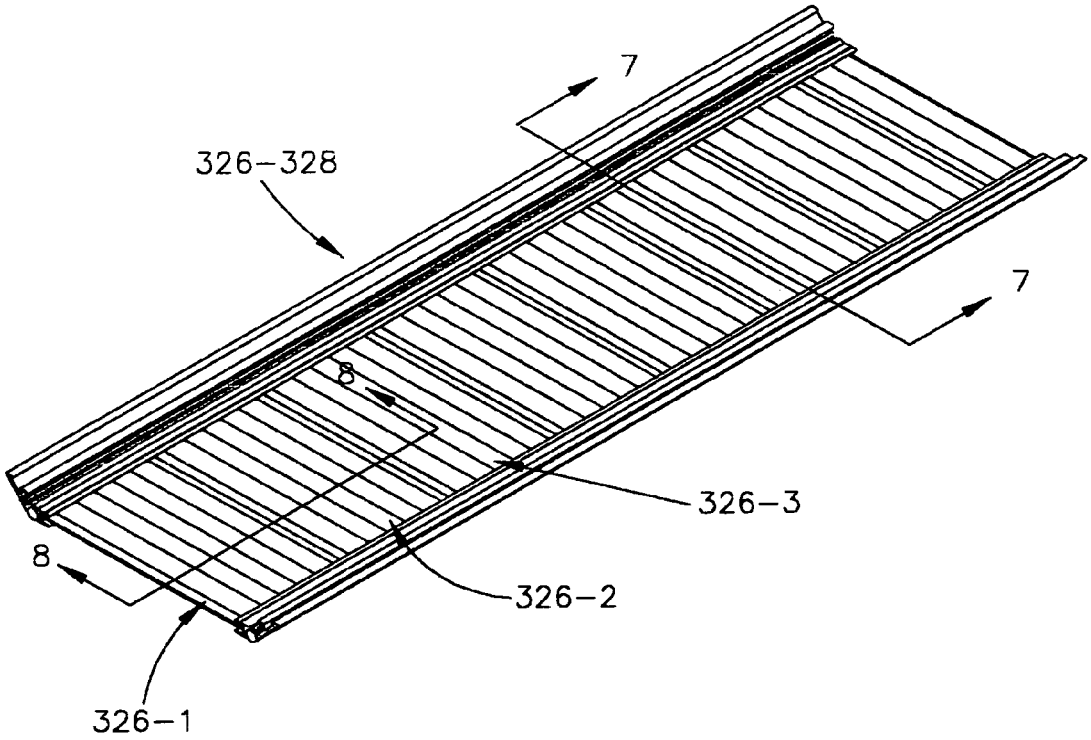
FIG. 6 is a perspective view of one embodiment of a cover having a modular center plate that is suitable for use in the expansion joint cover shown in FIG. 5.
Figure 7:
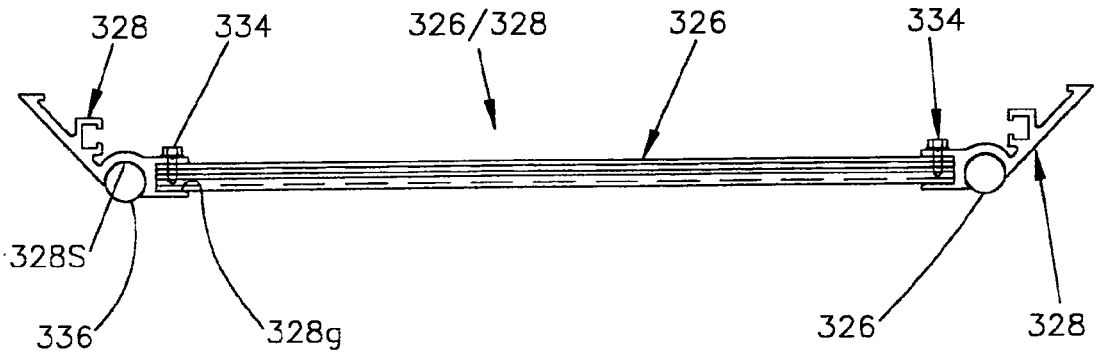
FIG. 7 is a cross-sectional view taken along the lines 7—7 of FIG. 6.
Figure 8:
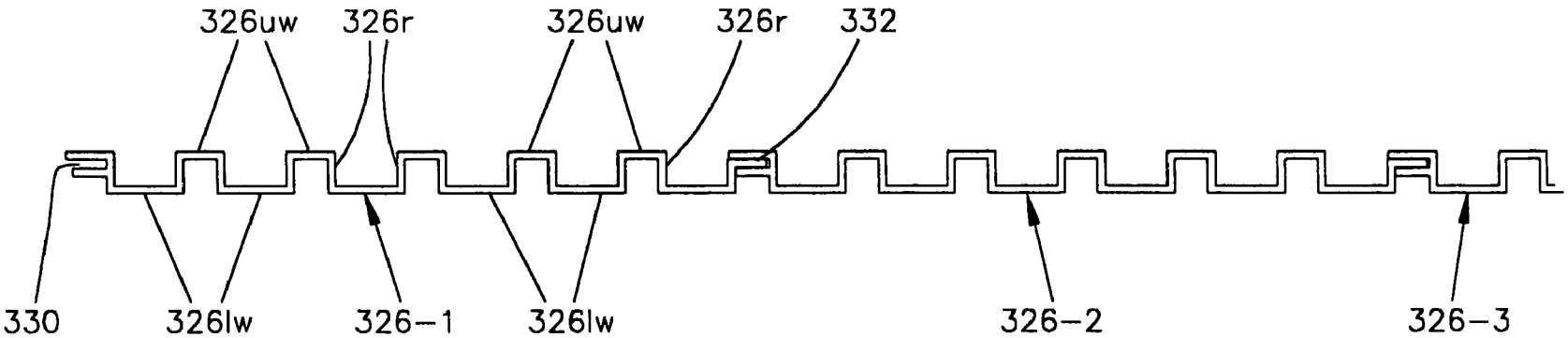
FIG. 8 is a partial cross-sectional view of the modular center plate of FIG. 6, taken along the lines 8—8 of FIG. 6.

The cover 326/328 of FIGS. 6 to 8 replaces the cover shown in FIG. 5. Several side-by-side formed members 326-1, 326-2, 326-3, etc., form a modular center plate. Each formed member 336 is formed by extrusion and is of corrugated form, consisting of transversely spaced-apart planar upper web portions 336*uw*, a plurality of transversely spaced-apart planar lower web portions 326*lw* staggered between the upper web portions, and a rib portion 326*r* joining each edge of each upper web portion to an edge of each lower web portion. A pair of flanges on one side edge form a groove 330 that mates with a flange or tongue 332 on the other side of an adjacent formed member, thus forming a slip joint between each adjacent pair of formed members 326.

An end frame member 328 is affixed to each end of the array of formed members 326 that form the modular center plate. A portion of the end of each formed member 326 is received in a groove 328*g* at the base of the end frame member. "Tek" screws 334, a form of self-drilling/tapping screw, installed at intervals join the end frame members 328 to the center plate. A rigid, low friction plastic rod 336 slides endwise into a partially open receiving socket 328*s* in each end frame member and is locked in place endwise by a few fasteners (not shown). The rods 336 support the cover 336/338 on the frames 210 (FIG. 5) and also engage the sloping portions of the frames 210 when the expansion gap closes in an earthquake, thus providing a camming action that pushes the cover upwardly out of the gap and clear of the frames against the bias of the hold-down assemblies 230 (FIG. 5).

Figure 10:
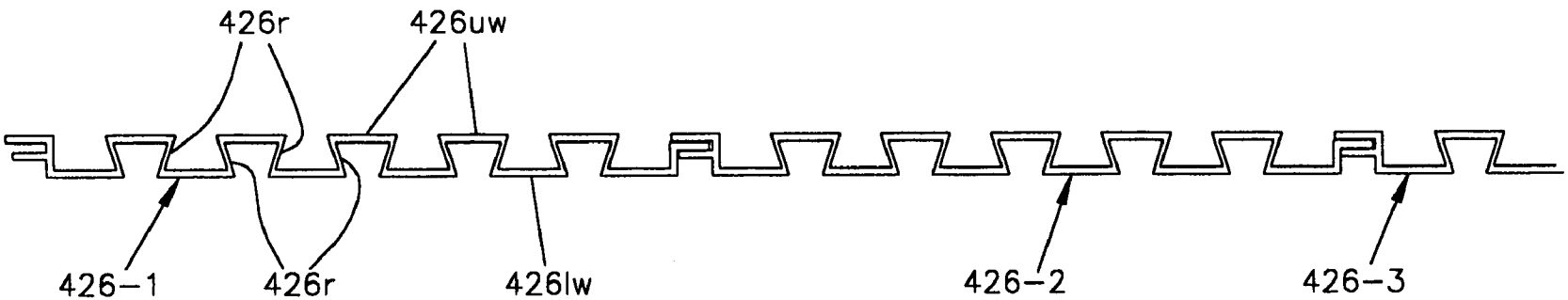
FIG. 10 is a partial cross-sectional view taken along the lines 10—10 of FIG. 9.

FIGS. 9 and 10 show a slightly modified cover 426/428, which can be used in the expansion joint cover of FIG. 5. The only difference between the cover of FIGS. 6 to 8 and that of FIGS. 9 and 10 is that the ribs 426*r* lie obliquely to the planar web portions 426*uw* and 426*lw*, thus forming dovetail-shaped grooves. The upwardly open grooves between the ribs provide a good mechanical lock for concrete, which is sometimes used as a floor surface or subsurface material for the cover.

Figure 11:
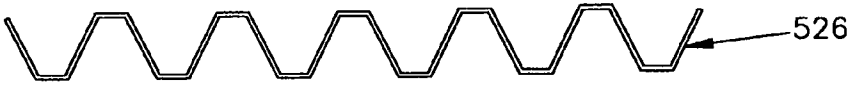
FIG. 11 is an end elevational view of another embodiment of formed member.
Figure 12:
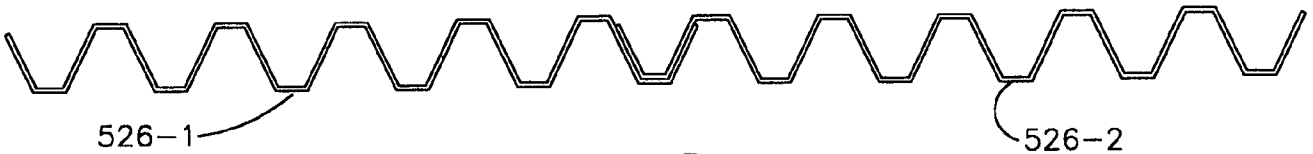
FIG. 12 is and end elevational view showing a joint between two of the formed members of FIG. 10.

The formed member 526 shown in FIG. 11 is made by roll-forming from light-gage (e.g., 20 to 24 gage) galvanized steel sheet. As shown in FIG. 12, several formed members 526-1 and 526-2 (only two are shown) can be arranged side by side and coupled by nesting of the outermost corrugations. The modular center plate of FIG. 12 is especially useful when the cover is of the type shown in FIG. 5 and the center plate acts essentially as a form for poured concrete. The center plate need only support the concrete when it is poured. In the finished cover, the concrete is the load-bearing component.

A variant of the embodiment of FIGS. 10 and 11 is a formed member of any suitable shape and extruded or thermo-formed from a plastic, which could well be recycled from waste. Such a formed member serves essentially only as a form for poured concrete. The concrete itself is anchored to the end frame members of the cover, such as by anchor bolts joined to the end frame members and embedded in the poured concrete.

Figure 13:
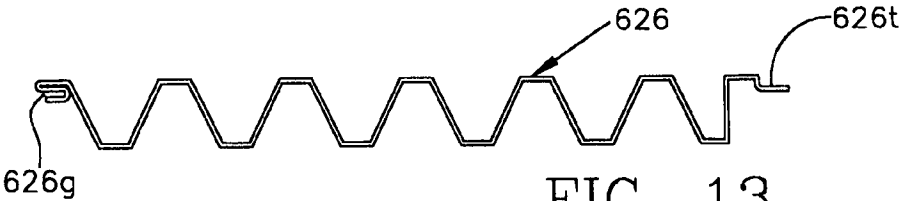
FIG. 13 is an end elevational view of another embodiment of formed member.
Figure 14:
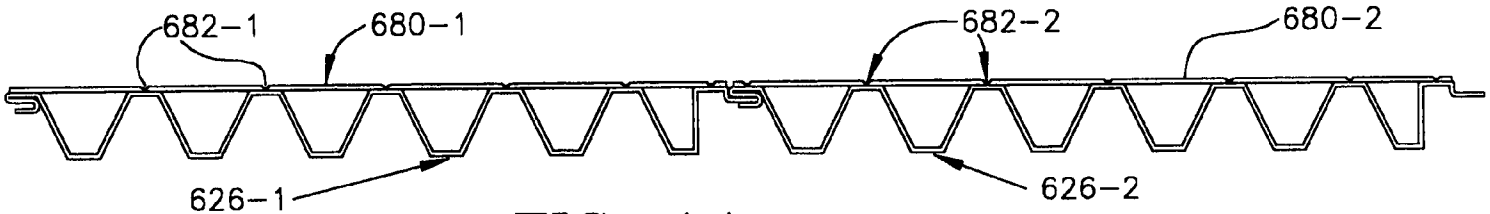
FIG. 14 is an end elevational view of a portion of modular center plate fabricated from the formed member of FIG. 13.

The formed member 626 of FIG. 13 is also made by roll forming of steel sheet. One edge has a formed groove 626*g* and the other a flange or tongue 626*t*. As shown in FIG. 14, the formed members 626 are joined by slip joints by reception of a tongue 626*t* on one member in a groove of the adjacent member. A planar steel sheet 680 is supported by and affixed to—such as by spot welds 682—the upper web portions of each of the formed members 626. A suitable floor covering, such as carpet or floor tile (not shown), can be applied to the planar surface presented by the sheets 680 of the modular center plate. The modular center plate units 626/680 are received by and affixed to suitable end frame members (not shown) to complete the cover.

The embodiments of modular center plates for expansion joint covers described in detail above and shown in the drawings are entirely exemplary and can be modified considerably as far as the cross-sectional shapes are concerned. The slip joints are desirable for linking the formed members to each other and for forming an air and liquid seal, but they are not essential—the formed members can have overlapping flanges at the side edges or simply abut each other. Similarly, the shapes of the end frame members are subject to many variations. Welding can be used in place of some or all mechanical fasteners. The expansion joint covers of FIGS. 1 and 5 are included herein to show the general type of environment for the modular center plates of the present invention. It is contemplated that the modular center plates can be used to advantage in expansion joint covers of many other configurations.

What is claimed is:

1. An expansion joint cover comprising:

a pair of elongated frames, one of which is adapted to be secured in the lengthwise direction thereof to a building member extending along one side of an expansion gap and the other of which is adapted to be secured in the lengthwise direction thereof to another building member extending along the other side of the expansion gap, and each of which frames has an elongated planar support surface extending along the expansion gap, and an elongated cover that is adapted to span the expansion gap and is supported on the planar support surfaces of the respective frames for sliding movement of the frames relative to the cover in a direction transverse to the expansion gap, wherein the cover includes a modular center plate made up of a plurality of formed members, each formed member being rectangular in plan and of uniform cross-section along an axis in the transverse direction thereof and having side edges parallel to the axis, and the formed members being arranged with their side edges adjacent each other and with their ends overlying the planar support surfaces of the frames for said sliding movement relative thereto.

2. The expansion joint cover according to claim 1, wherein adjacent pairs of formed members are coupled together by joints between the side edges.

3. The expansion joint cover according to claim 1, wherein adjacent pairs of formed members are coupled together by slip joints between the side edges.

4. The expansion joint cover according to claim 1, wherein all of the formed members of the modular center plate are of the same cross-section.

5. The expansion joint cover according to claim 1, wherein the modular center plate includes a continuous edge frame member affixed to each end of the plurality of formed members.

6. The expansion joint cover according to claim 1, wherein each of the formed members has corrugations.

7. The expansion joint cover according to claim 1, wherein each of the formed members has a plurality of transversely spaced-apart planar upper web portions, a plurality of transversely spaced-apart planar lower web portions staggered between the upper web portions, and a rib portion joining each edge of each upper web portion to an edge of each lower web portion.

8. The expansion joint cover according to claim 7, wherein the upper web portions of all of the formed members are coplanar and the lower web portions of all of the formed members are coplanar.

9. An expansion joint cover comprising:

a pair of elongated frames, one of which is adapted to be secured in the lengthwise direction thereof to a building member extending along one side of an expansion gap and the other of which is adapted to be secured in the lengthwise direction thereof to another building member extending along the other side of the expansion gap, and each of which frames has an elongated planar support surface extending along the expansion gap, and an elongated cover that is adapted to span the expansion gap and is supported on the planar support surfaces of the respective frames for sliding movement of the frames relative to the cover in a direction transverse to the expansion gap, wherein the cover includes a modular center plate that is made up of a plurality of identical formed members, each formed member being rectangular in plan and of uniform cross-section along an axis in the transverse direction thereof and having side edges parallel to the axis and the formed members being arranged with their side edges adjacent each other and with their ends overlying the planar support surfaces of the frames for said sliding movement relative thereto, and a continuous end frame member affixed to each end of the plurality of formed members.

10. The expansion joint cover according to claim 9, wherein each end frame member includes spaced-apart upper and lower flanges forming a groove and the formed members are affixed to the end frame members by reception of end portions thereof in the grooves.

11. The expansion joint cover according to claim 10, wherein each end of the modular center plate is supported on the support surface of the frame member by the lower flange of the end frame member.

12. The expansion joint cover according to claim 9, wherein each end of the modular center plate is supported on the support surface of the frame member by a rod of a rigid low friction polymeric material received in a partially open socket in the end frame member.

13. The expansion joint cover according to claim 9, wherein each of the formed members is corrugated.

14. The expansion joint cover according to claim 9, wherein each of the formed members has a plurality of transversely spaced-apart planar upper web portions, a plurality of transversely spaced-apart planar lower web portions staggered between the upper web portions, and a rib portion joining each edge of each upper web portion to an edge of each lower web portion.

* * * * *